US008672536B2

(12) United States Patent
Henein et al.

(10) Patent No.: US 8,672,536 B2
(45) Date of Patent: Mar. 18, 2014

(54) ISOCHRONISM CORRECTOR FOR CLOCKWORK ESCAPEMENT AND ESCAPEMENT PROVIDED WITH SUCH A CORRECTOR

(75) Inventors: Simon Henein, Neuchatel (CH); Philippe Schwab, Grandevent (CH)

(73) Assignee: CSEM Central Suisse d'Electronique et de Microtechnique SA—Recherche et Development, Neuchatel (CH)

( * ) Notice: Subject to any disclaimer, the term of this patent is extended or adjusted under 35 U.S.C. 154(b) by 749 days.

(21) Appl. No.: 12/858,606

(22) Filed: Aug. 18, 2010

(65) Prior Publication Data

US 2011/0044139 A1 Feb. 24, 2011

(30) Foreign Application Priority Data

Aug. 18, 2009 (EP) ..... 09168113

(51) Int. Cl.
*G04B 17/20* (2006.01)

(52) U.S. Cl.
USPC ..... 368/170; 368/171; 368/128

(58) Field of Classification Search
USPC ..... 368/170, 171
See application file for complete search history.

(56) References Cited

U.S. PATENT DOCUMENTS 3,695,032 A * 10/1972 Lawson et al. ..... 368/171
7,963,693 B2 * 6/2011 Genequand ..... 368/170

FOREIGN PATENT DOCUMENTS

| | | |
|---|---|---|
| CH | 386935 | 9/1964 |
| EP | 1736838 | 12/2006 |
| FR | 648846 | 12/1928 |

OTHER PUBLICATIONS

European search report dated Jan. 26, 2010 in corresponding EP 09168113.0.

* cited by examiner

*Primary Examiner* — Amy Cohen Johnson
*Assistant Examiner* — Jason Collins
(74) *Attorney, Agent, or Firm* — Young & Thompson

(57) ABSTRACT

A mechanical oscillator isochronism corrector comprising a frame (12), a flexible blade (14) integral with the frame to act on a mechanical oscillator at a contact portion (14*a*) presented by the blade, and a first element for adjusting the pre-stress of the flexible blade including a pre-stress finger (22) acting on the flexible blade, the first adjustment element being integral with the frame.

18 Claims, 13 Drawing Sheets

ISOCHRONISM CORRECTOR FOR CLOCKWORK ESCAPEMENT AND ESCAPEMENT PROVIDED WITH SUCH A CORRECTOR

TECHNICAL FIELD

The present invention relates to a mechanical oscillator isochronism corrector including a frame, a flexible blade integral with the frame to act on the mechanical oscillator at a contact portion presented by the blade. The invention also concerns an escapement mechanism provided with such a corrector.

BACKGROUND OF THE INVENTION

The conventional oscillators that equip mechanical timekeepers comprise, traditionally, a spring, or spiral, element making it possible to return a regulator element, or balance, to the neutral position. The power dissipated by the oscillation is offset by the application of a motor torque provided by a load spring, or barrel spring. However, this driving torque exerted by the barrel spring varies over time as a function of the load (or winding state) of the latter and, in most mechanical timekeepers, in particular when the barrel is coupled directly to the trains of the dynamic chain, this variation results in modifying the oscillation amplitude as well as, to a certain extent, the period of the oscillator. Such a modification can amount, for certain embodiments, to a deviation of one to several tens of seconds per day.

To offset the effect of the intensity variation of the motor torque, it was proposed to use a device called fusee (see the "Dictionnaire professionnel illustré de l'horlogerie" by G. A. Berner), which makes it possible to regularize the driving force transmitted to the train by the barrel spring. However, such a device is difficult to miniaturize, and therefore cannot actually be applied in mechanical bracelet watches.

Another correction device was described in relation to FIG. 7 of European patent application EP 1736838 in the applicant's name. In the latter document, it is proposed to have the motor torque of the barrel spring act on a flexible organ, which controls the active length of an element that participates in the continuous oscillation of the mechanical oscillator.

As in the case of the fusee, such a device is not simple to implement and, above all, neither of the two devices makes it possible to take torque variations into account that are due to friction existing, for example, at the different parts including the oscillator as well as the trains for transmitting the motor torque to the latter.

In quasi-continuous oscillation regime, i.e. when the intensity of the motor torque varies sufficiently slowly relative to the oscillation period, one can allow that the period variation caused is equivalent to that which would be caused by a non-linear return torque as a function of the deflection. Such an isochronism flaw can be corrected by an inverse non-linearity of the return spring.

The aim of the invention is thus to provide a corrector for the isochronism flaw caused by the variations of the motor torque of the barrel spring, according to a principle of correction as a function of the amplitude.

More generally, the aim of the invention is to be able to maintain a constant frequency of the oscillator, in its useful operating field, based on the amplitude variations to correct an effect that can be likened to a non-linearity of the return spring.

BRIEF DESCRIPTION OF THE INVENTION

More precisely, the invention pertains to a mechanical oscillator isochronism corrector including

- a frame,
- a flexible blade integral with the frame to act on the mechanical oscillator at a contact portion presented by the blade,
- first means for adjusting the prestressing of said flexible blade comprising an organ acting on said flexible blade, said first adjustment means being integral with the frame.

The corrector can advantageously include second means for adjusting the position of the contact portion, to adjust the position in which the oscillator comes into contact with the flexible blade, said second adjustment means being integral with the frame and independent of the first adjustment means.

The invention also pertains to an escapement mechanism equipped with a corrector as proposed above.

Other advantageous features of the invention are defined in the claims.

BRIEF DESCRIPTION OF THE DRAWINGS

The invention will appear more clearly upon reading the following description, done in reference to the appended drawing, in which.

DETAILED DESCRIPTION OF THE INVENTION

Figures 2, 13:
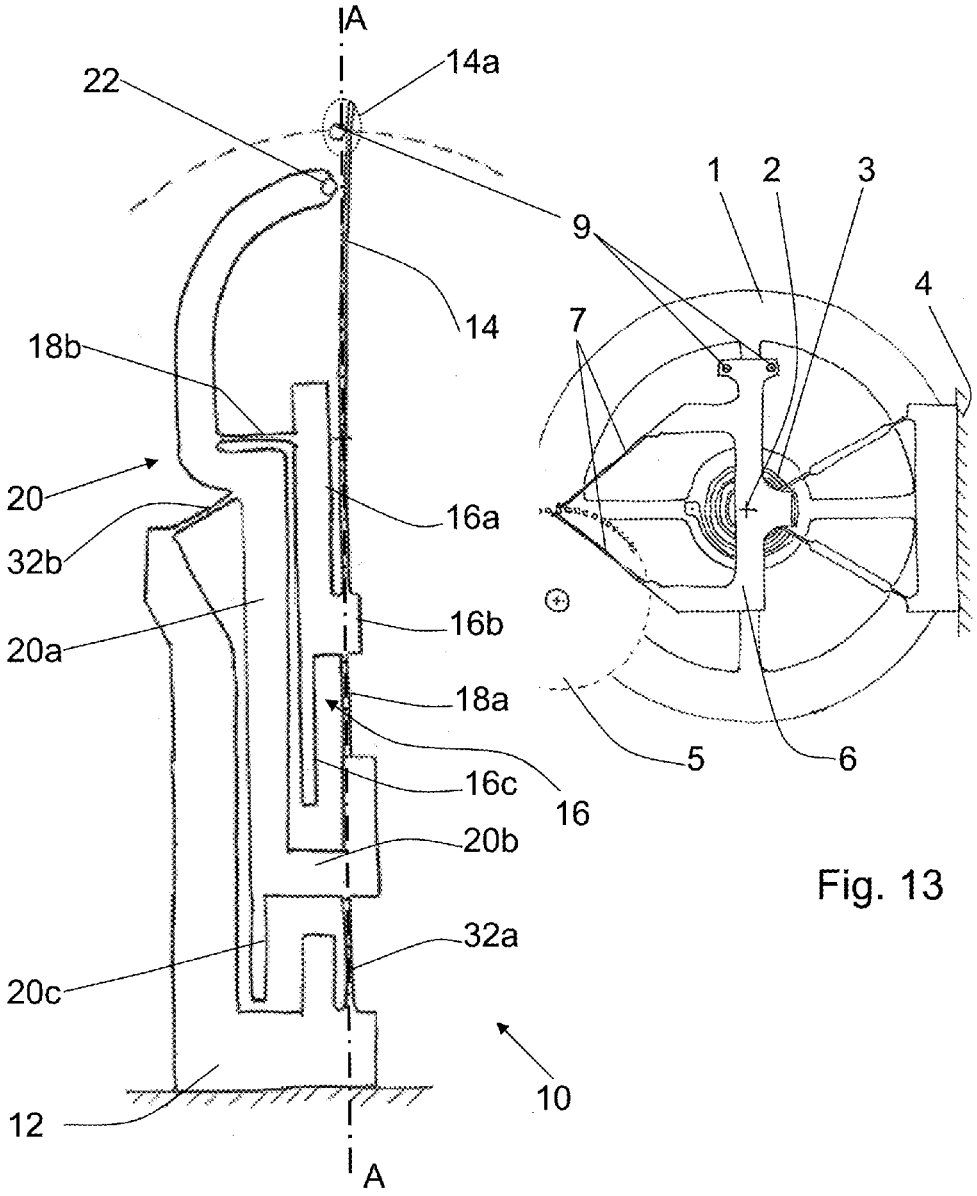

The isochronism corrector according to the invention is particularly applicable to the escapement system described in document EP 1736838, already cited, in particular to FIG. 2*a*, to which one may refer for details on the elements not specific to the present invention. The essential elements of such an escapement are shown in FIG. 13.

One recognizes a balance 1 (partially shown) oscillating around an axis 2 and its return spring, or balance spring, 3 fixed between an arm of the balance and a frame 4 of the watch. A T-shaped piece called pallet 6 can be associated with the balance, to form a two-step oscillator. According to the teaching of document EP 1736838, an escapement wheel 5 is driven by two elastic blades 7 connected, by one end, to the balance 1 or to the pallet 6, and the other end of which, or pallet-stone, engages in the teeth (partially shown) of the escapement wheel 5. In the present invention, the term mechanical oscillator designates the balance and its elastic return system, or the balance, its elastic return system and the pallet 6, forming a second step of the oscillator.

In oscillating, under the impulse of a motor torque dispensed by a barrel spring, the sprung balance drives the escapement wheel 5 in rotation at a rhythm that must be as regular as possible, as it determines the precision of the watch it controls. Yet, as previously mentioned, mechanical watches and, more particularly, those equipped with an escapement system as just described, suffer from a lack of isochronism that can translate to a deviation of several tens of seconds per day for a ten percent variation of the motor torque, corresponding to a five percent amplitude variation. Such a deviation is related to the fact that, unlike free escapement systems, such as those called Swiss pallet, the particular pallet 6 of the aforementioned EP document is, via its elastic blades 7, in continuous contact with the escapement wheel 5. During its discharge, the motor torque of the barrel spring decreases, which causes a corresponding decrease of the oscillation amplitude of the oscillator (to maintain the balance with the dissipated power) and also of its frequency due to the continuous contact. For small variations, corresponding to the operating field, one can allow that the frequency varies linearly with the variations of the motor torque.

The principle of the invention consists of providing the oscillator with a corrector 10 having a frequency characteristic opposite its own in the operating field.

Figure 1:
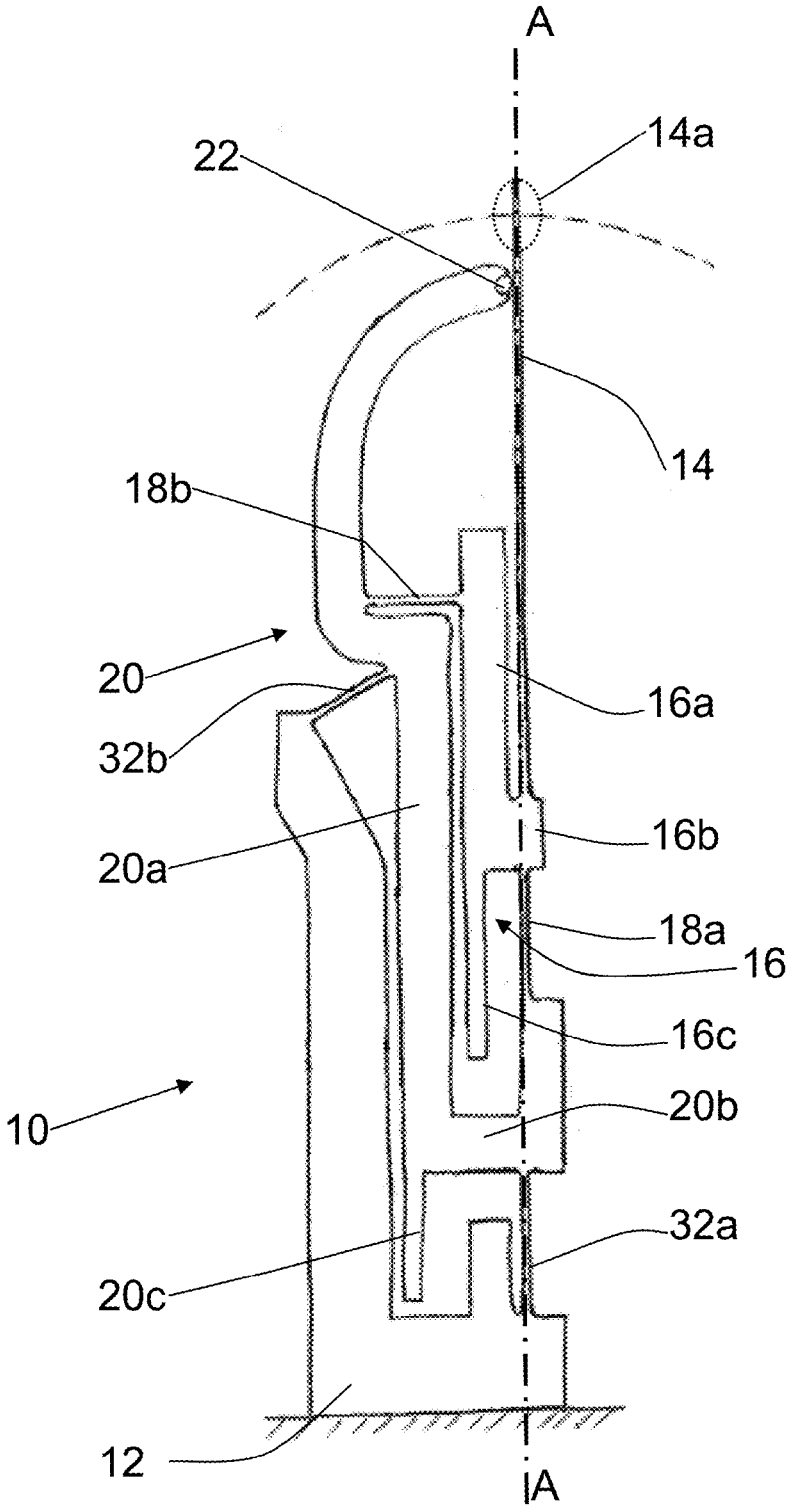
FIG. 1 illustrates a top view of a corrector according to the invention, in neutral position, i.e. without action of the adjustment means, FIGS. 2, 3 and 4 also show a top view of a corrector according to the invention, in neutral position, but in different cooperation situations with an oscillator organ of the escapement.

FIG. 1 illustrates such a corrector. It includes a frame 12, designed to allow the assembly of the corrector on the watch movement in which it participates. This frame 12 is rigid and makes it possible to ensure the precise positioning of the corrector in reference to the escapement. It therefore makes it possible, also, to serve as referential for the mobile parts of the corrector that will be described hereinafter. The corrector 10 also includes a flexible blade 14, integral with the frame and defining a longitudinal axis AA. This flexible blade is designed to cooperate with the oscillator of the escapement, in particular with its pallet 6, at a pin 9 integral with the pallet, FIG. 13 showing two of these. According to the teaching of application EP08101699 in the applicant's name, it will thus be recalled that, for small amplitudes of the balance, the flexible blade 14 is in contact with the pallet 6 at a contact portion 14*a* and it constitutes an additional spring that acts on the balance as a complement to the balance spring 3. If the amplitude of the oscillations increases, there is a moment where the flexible blade 14 stops being in contact with the pallet, thereby modifying the elastic constant of the global return spring. This creates a negative non-linearity, constituted on one hand by a decreased slope and on the other hand by a jump in strength, in the response of that global return spring, and it is that non-linearity that makes it possible to offset the lack of positive isochronism mentioned above (i.e., a frequency that increases when the amplitude increases). The adjustment means proposed in application EP08101699 are difficult to implement from a practical perspective. Particularly, the described device does not make it possible to adjust the pre-stress exerted on the elastic blade, this pre-stress being exerted by a fixed banking.

Particularly to the invention, the flexible blade 14 is connected to the frame via adjustment systems, which will now be described. The blade 14 is embedded on a first intermediate element 16. The latter includes, according to the example illustrated in the drawing, a body 16*a* of generally parallelepiped shape, with axis parallel to axis AA in neutral position. This body 16*a* is provided with a transverse leaf 16*b*, on which the flexible blade 14 is embedded. Moreover, the body 16*a* is extended by a tail 16*c* making it possible to limit the movements of the body 16*a*. The first intermediate element 16 is integral with the frame 12, owing to first 18*a* and second 18*b* elastic blades. The first elastic blade 18*a* is arranged integrally on the leaf 16*b*, in the extension of the flexible blade 14. The second blade 18*b* is arranged integrally on the body 16*a*, on the side opposite the flexible blade 14, along a direction perpendicular to the first blade 18*a*. The elastic blades are connected to second intermediate element, serving as first reference element, relative to which the elastic blades 18*a* and 18*b* can deform. As will be better understood hereinafter, the elastic blades 18*a* and 18*b*, associated with the first intermediate element 16, form a first deformable structure. More particularly, this is a structure elastically deformable around a remote center compliant flexure pivot, the center of rotation of which is situated at the intersection of the elastic blades.

Figure 5:
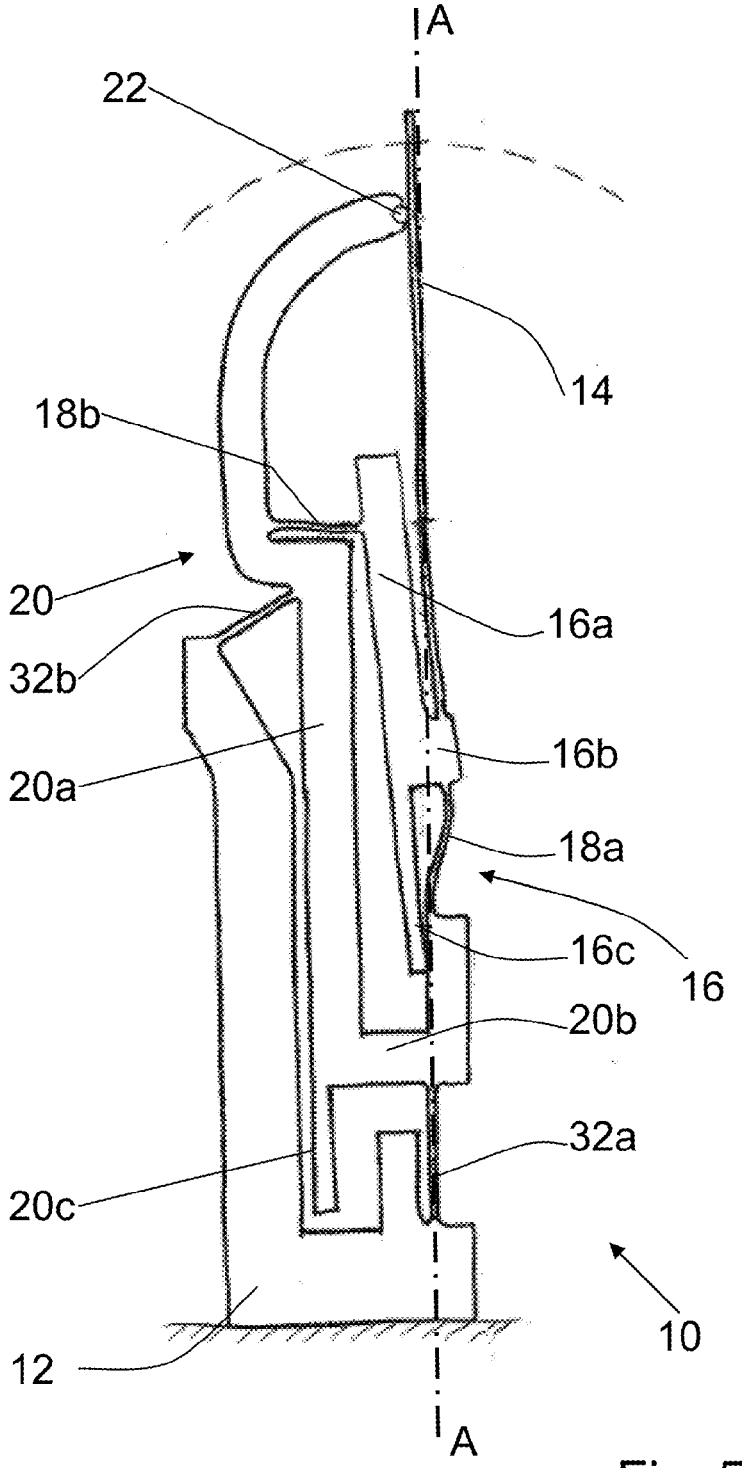
FIG. 5 shows a top view of a corrector according to the invention, with a deliberately exaggerated view of the action of the first adjustment means.

The first reference element is provided with a pre-stress finger 22, positioned so as to exert a stress on the flexible blade 14. The first reference element then being fixed during deformations of the deformable structure, it is understood that the flexible blade 14 moves in reference to the pre-stress finger 22, which results in modifying the stress exerted by the finger on the flexible blade 14, as illustrated in FIG. 5.

Figure 10:
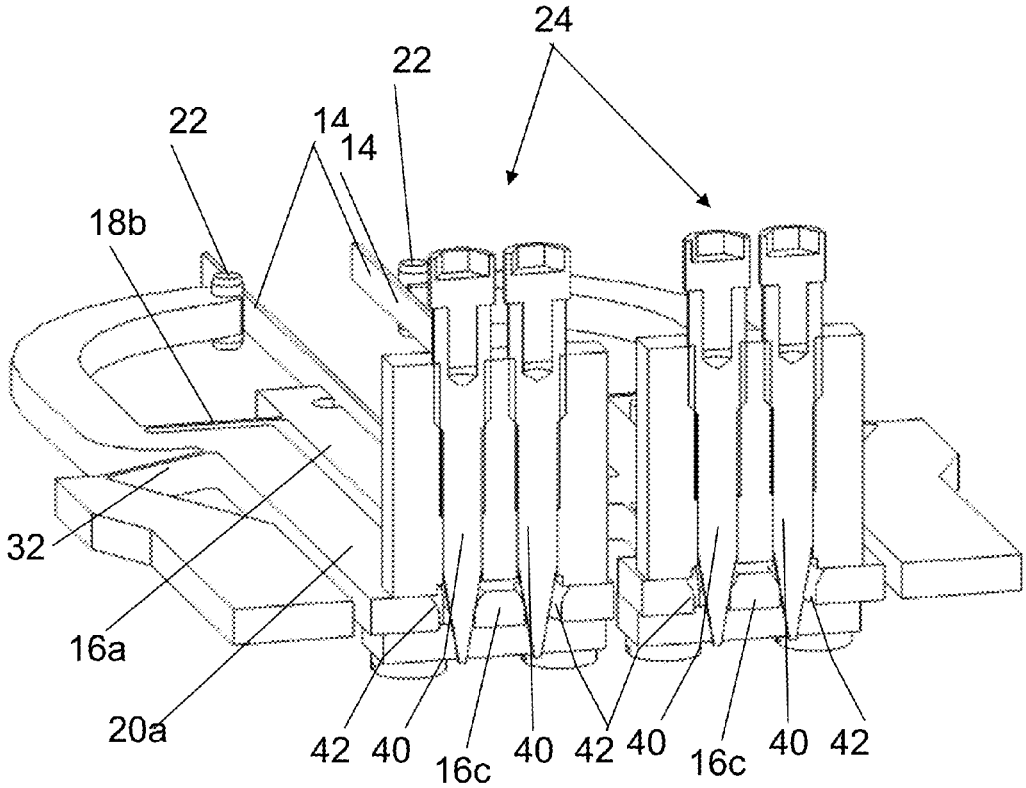
Figure 11:
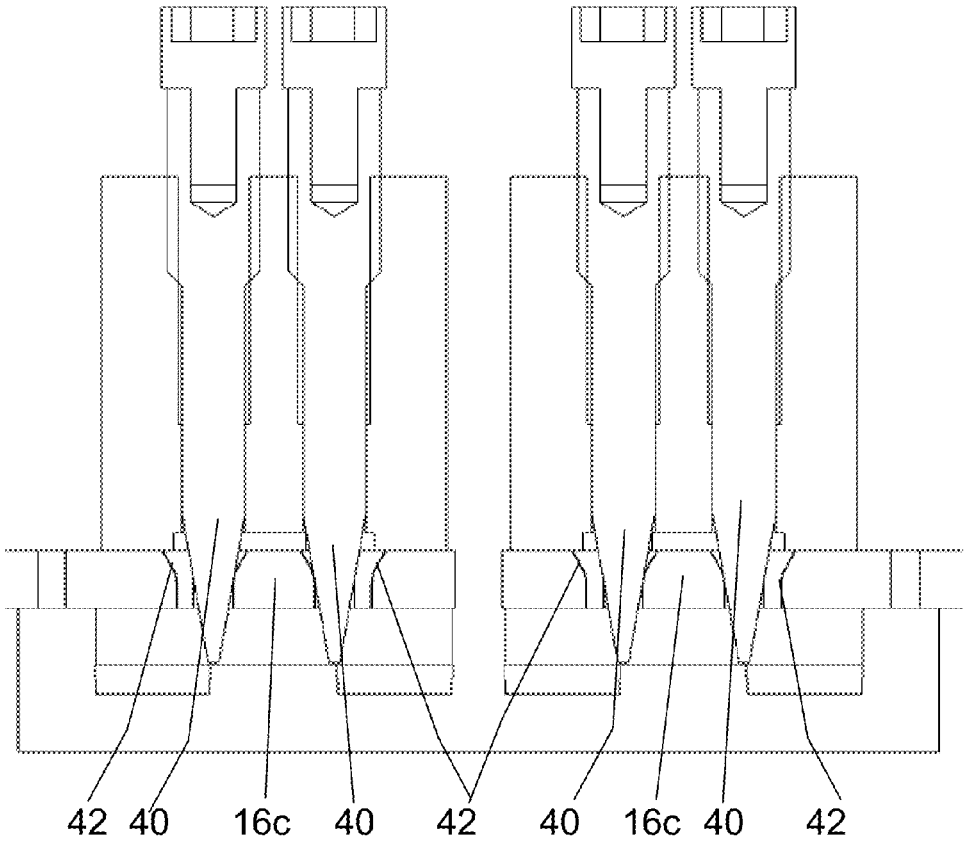

A positioning system 24 of the deformable structure, which will be described in detail later in reference to FIGS. 10 and 11, is arranged to act on the first intermediate element 16 at the tail 16*c*, and to move the flexible blade 14 around the center of rotation of the first deformable structure and to thereby adjust the pre-stress it undergoes. In passing, one will note, in FIG. 5, the limitation of travel achieved owing to the tail 16*c*, which bears on the reference element.

More particularly, the second intermediate element 20 includes, according to the example illustrated in the drawing, a body 20*a* with a generally parallelepiped shape, with axis parallel to axis AA in neutral position. This body 20*a* is provided with a transverse leaf 20*b*, on which the elastic blade 18*a* is embedded. Moreover, the body 20*a* is extended by a tail 20*c* making it possible to limit the movements of the body 20*a*. The second intermediate element 20 is integral with the frame 12, owing to first 32*a* and second 32*b* elastic blades. The first elastic blade 32*a* is arranged on the leaf 20*b*, in the extension of the flexible blade 14 and of the elastic blade 18*a*. The second blade 32*b* is arranged on the body 20*a*, on the side opposite the flexible blade 14. The elastic blades 32*a* and 32*b* are connected to the frame 12, serving as second reference element, relative to which the elastic blades 32*a* and 32*b* can deform. As will be better understood hereinafter, the elastic blades 32*a* and 32*b*, associated with the second intermediate element 20, form a second deformable structure. More particularly, this is a structure elastically deformable around a remote center compliant flexure pivot, the center of rotation of which is situated at the intersection of the elastic blades. The elastic blade 32*b* is arranged such that the center of rotation of the first deformable structure is combined with that of the second deformable structure.

Figure 6:
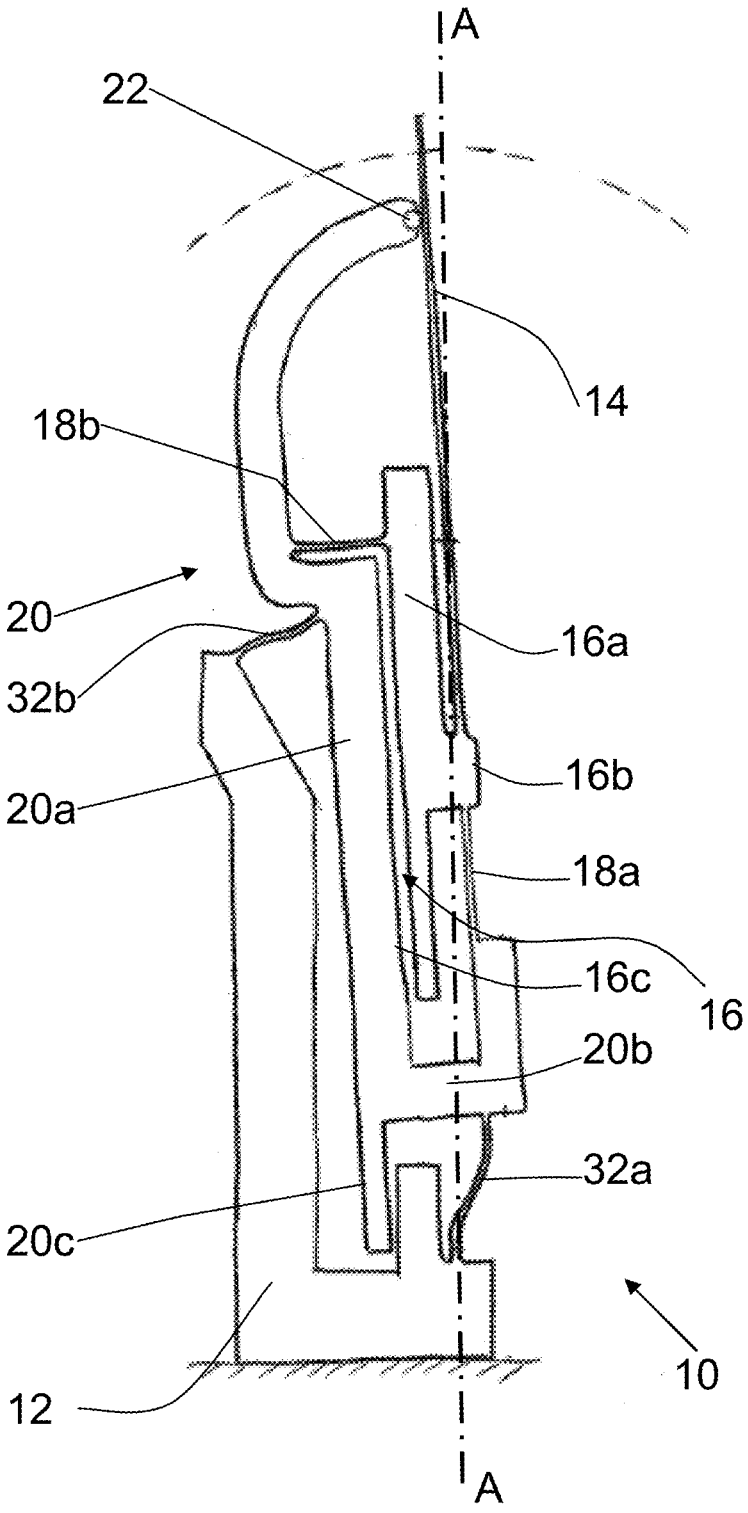
FIG. 6 shows a top view of a corrector according to the invention, with a deliberately exaggerated view of the action of the second adjustment means.

During the deformation of the second elastic structure, the body 20 moves relative to the frame 12, integral with the first elastic structure and the flexible blade 14. Thus, the flexible blade 14 and particularly its end and its contact portion 14*a* designed to come into contact with the pallet 6, move in reference to the oscillator, which results in modifying the position of the blade along the path followed by the pin 9, as shown in FIG. 6. It will be noted in passing that this adjustment has no influence on the pre-stress strength of the flexible blade 14 against the pre-stress finger 22, given that the blade 14 and the finger 22 move integrally.

Figure 12:
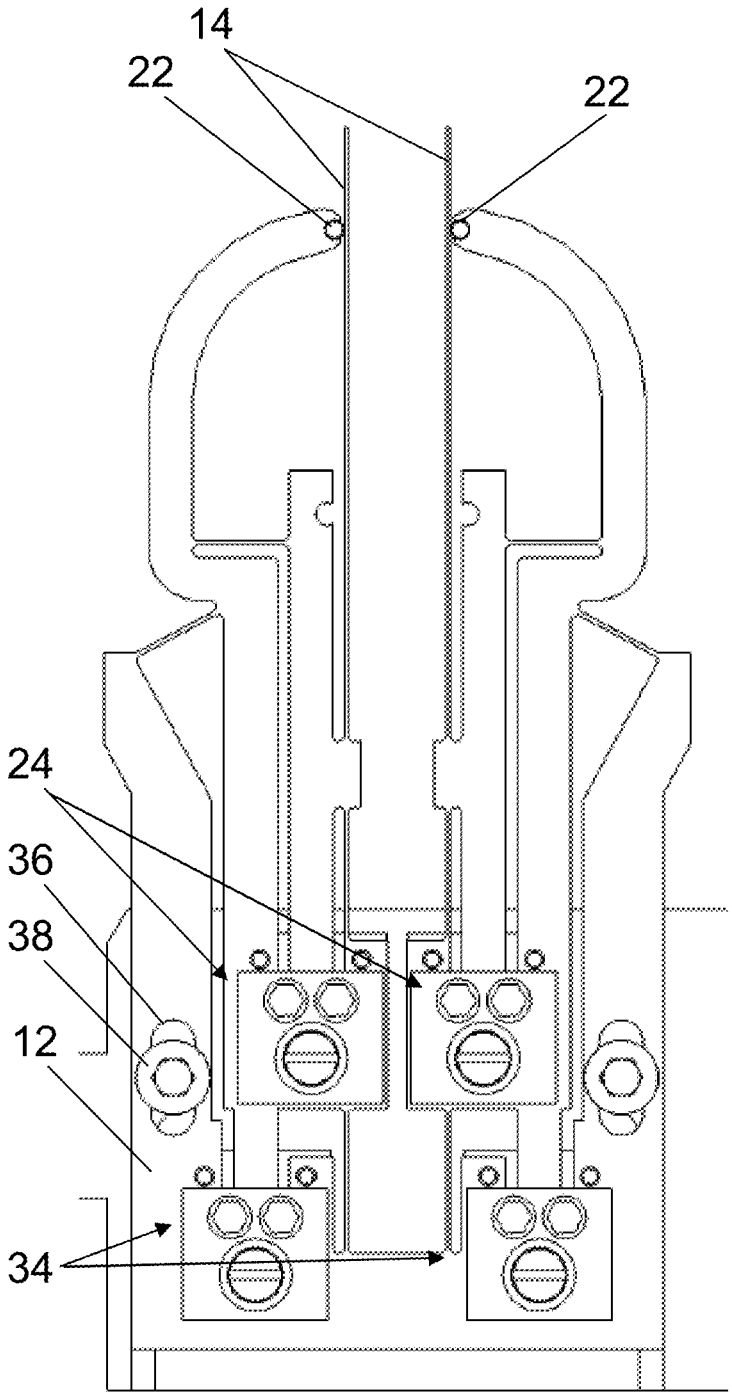

A positioning system 34 of the second deformable structure, which will be described in detail later in reference to FIGS. 10, 11 and 12, is arranged to act on the second intermediate element 20 at the tail 20, and move the flexible blade 14 and the first reference element around the center of rotation of the second deformable structure and thereby adjust the point of contact between the pin 9 of the pallet 6 and the flexible blade 14. One will note in passing, in FIG. 6, the limitation of travel achieved owing to the tail 20*c*, which bears on the frame 12.

Figure 3:
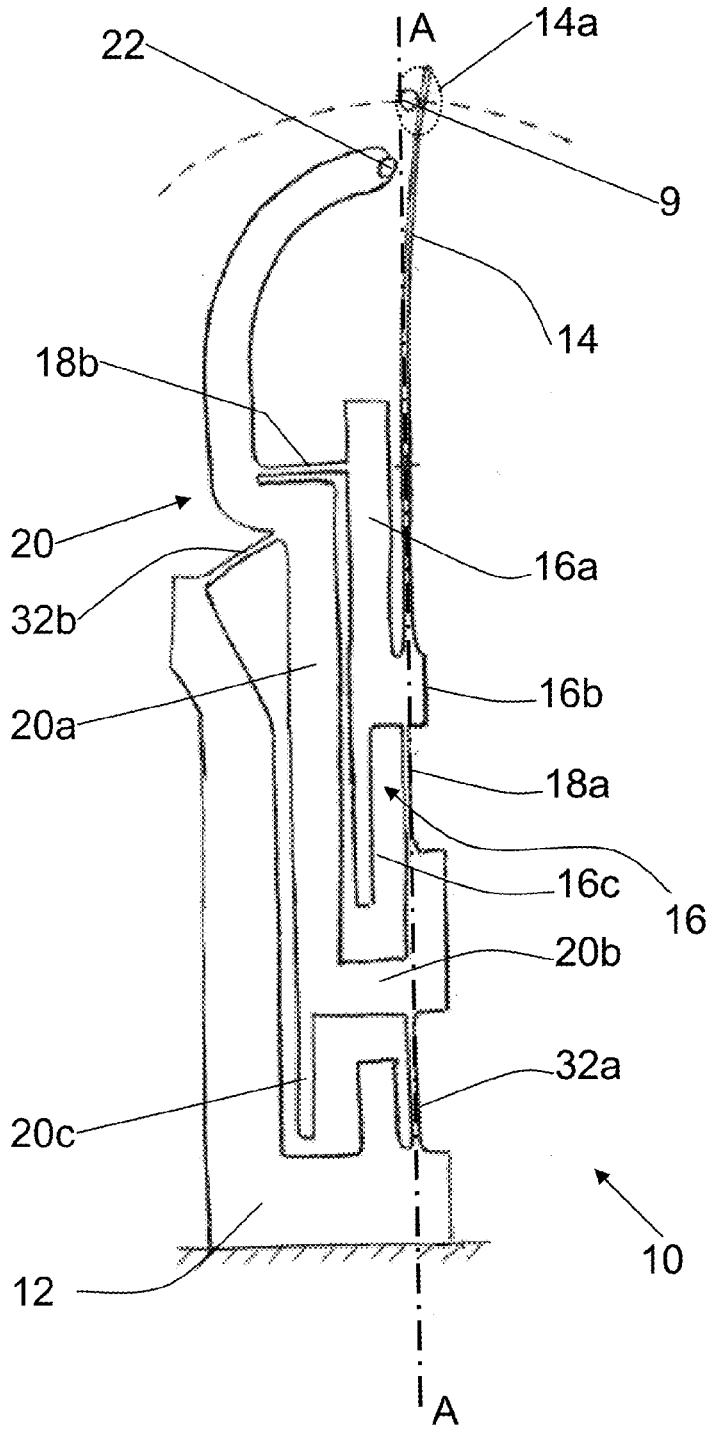
Figure 4:
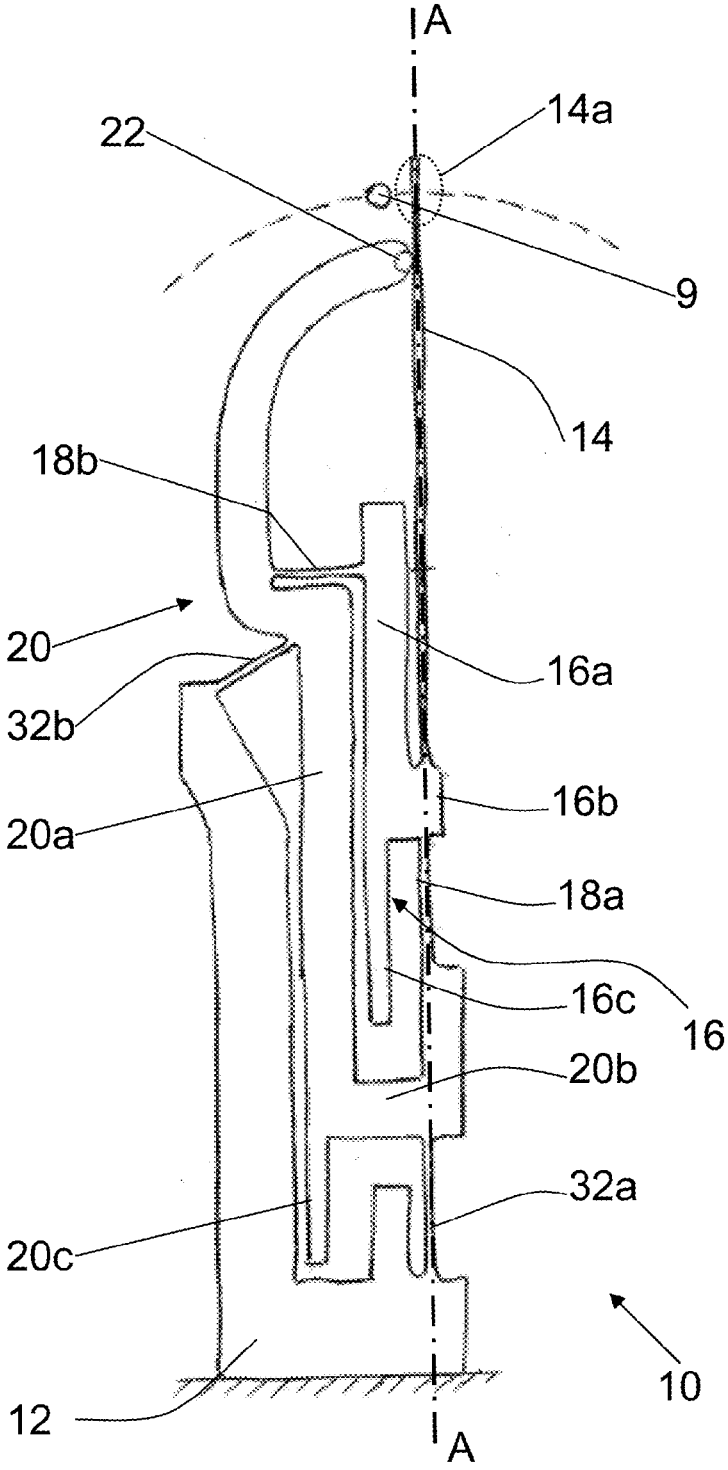

FIGS. 2 to 4 show different positions of the pin 9 in reference to the flexible blade 14, during an oscillation of the oscillator, in order to better understand the action of flexible blade 14 on the oscillator of the movement. In these FIGS. 2 to 4, the flexible blade 14 is in its neutral position, i.e. the first and second elastically deformable structures are not deformed by their respective positioning systems.

In FIG. 2, the flexible blade 14 bears against the pin 9 integral with the pallet 6. It will be noted that, for optimal operation of the corrector, and as shown particularly in FIG. 9, the center of the circular path followed by the pin 9 is situated in the plane of the flexible blade 14, of length L, at a distance L/3 from its embedding point in the transverse leaf 16*b*. The center of rotation of the pallet 6 coincides with the pivot centers of the elastically deformable structures. In FIG. 2, the pin 9 is shown in the position it occupies when the pallet 6 is in neutral position, i.e. with the balance spring idle. In this position, the flexible blade is unstuck from the pre-stress finger 22.

In FIG. 3, the pin 9 is shown in the position it occupies when the pallet 6 is in the extreme right position, in reference to the drawing. In this position, the flexible blade 14 is further unstuck from the pre-stress finger 22 than in the position of FIG. 2.

In FIG. 4, the pin 9 is shown in the position it occupies when the pallet 6 is in the extreme left position, in reference to the drawing. In this position, the flexible blade 14 bears against the pre-stress banking and is no longer in contact with the pin 9 of the pallet 6.

Figure 9:
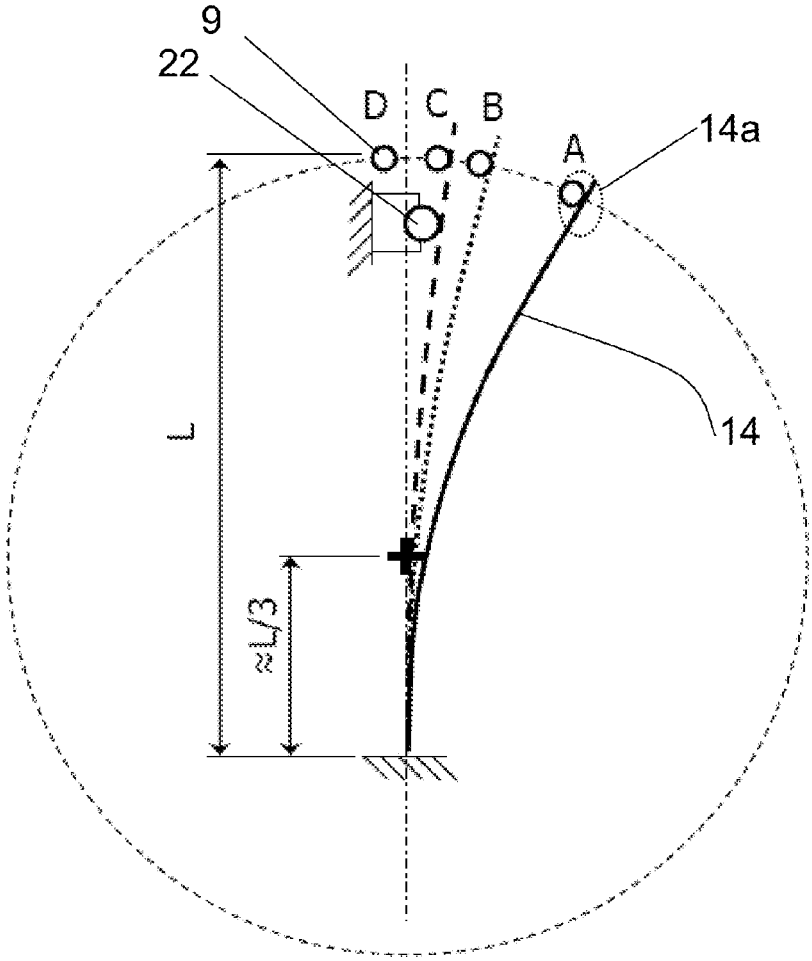
FIG. 9 is a diagrammatic view of the geometric arrangement of certain elements of the corrector and of the oscillator organ of the escapement, FIGS. 10 and 11 more particularly illustrate the positioning systems of the adjustment means, FIG. 12 proposes a top view of a corrector according to the invention, of its adjustment means including the positioning systems, FIG. 13 diagrammatically illustrates an escapement mechanism on which an isochronism corrector according to the invention can advantageously be integrated, and FIG. 14 proposes another alternative embodiment of a corrector according to the invention, particularly of the flexible blade.

FIG. 9 diagrammatically illustrates these different positions. Thus, the pin 9 follows an alternating movement along the circle arc drawn in dashed line. Position A represents the extreme angular position at the pin 9 during its oscillation, the pin is in contact with the flexible blade 14. In position B, the pin 9 is in neutral position, and is in contact with the flexible blade 14. In position C, the blade bears on the pre-stress finger 22 and leaves the pin 9 of the pallet 6. This produces a slope break and strength jump of the angle-torque characteristic of the oscillator, due to the loss of contact of the latter with the flexible blade 14. Position D shows the extreme left position of the pin, in which there is no contact between it and the flexible blade 14. As mentioned above, to minimize the friction of the pin 9 on the flexible blade 14, the latter is placed such that:

the center of rotation of the pallet is situated in the plane of the flexible blade 14, the center of rotation of the pallet is situated at a distance of about ⅓ of the total active length of the blade, in reference to its embedding point.

Thus, the contact portion 14*a* of the blade 14 with the pin 9 follows a path essentially combined with that of the pin 9, thereby minimizing the relative friction between those two parts. Moreover, as mentioned above, the adjustment of the contact angle between the pin 9 and the flexible blade 14, adjusted by the second elastically deformable structure, has no influence on the adjustment of the pre-stress. Moreover, for the adjustment of the pre-stress also to have little or no influence on the adjustment of the contact angle, the pre-stress finger 22 must be placed as close as possible to the contact portion 14*a* of the flexible blade 14 designed to be in contact with the pin 9. It may first be considered that the adjustment of the pre-stress and the adjustment of the contact angle are independent of one another.

Figure 7:
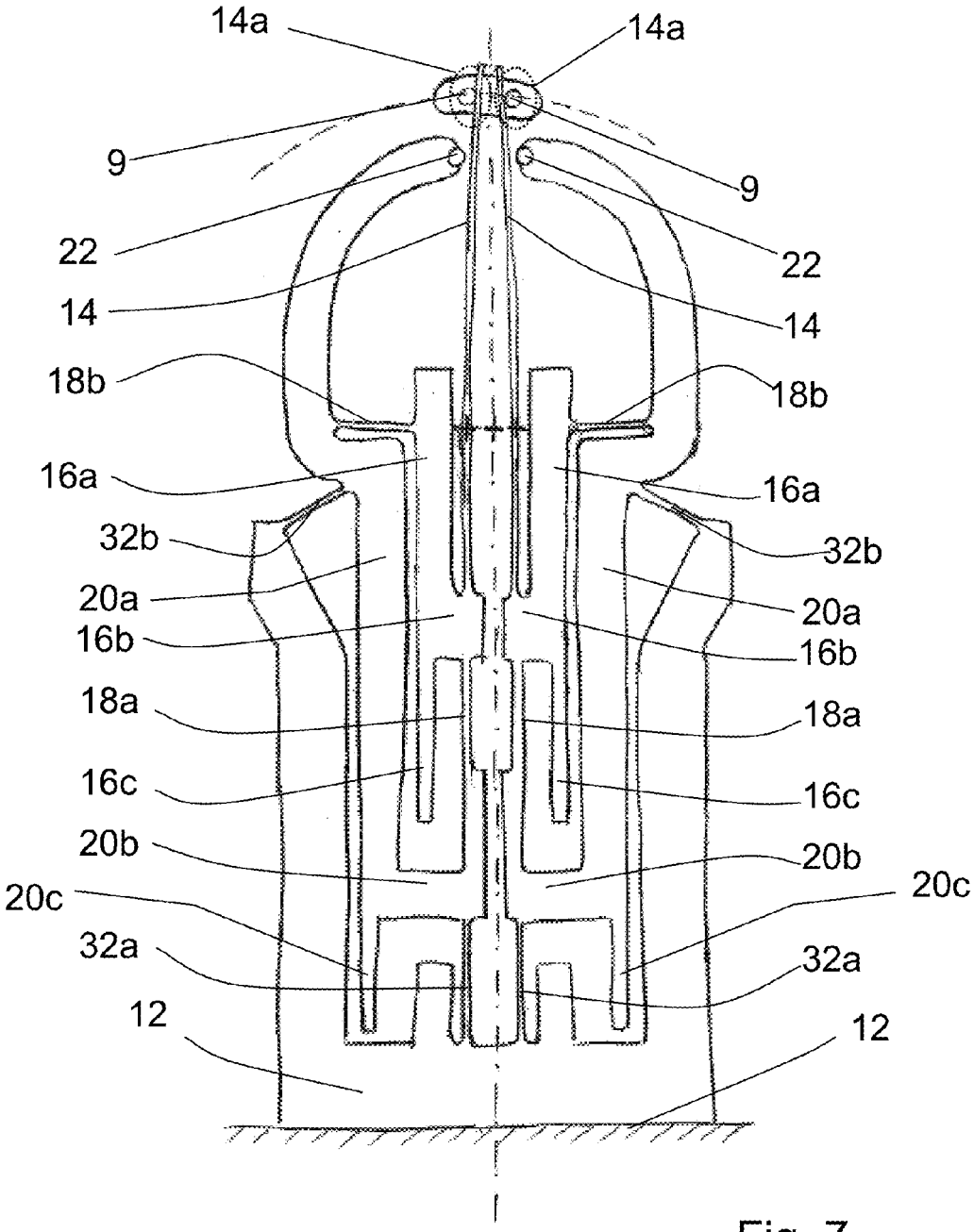
FIG. 7 shows a second embodiment of a corrector according to the invention, in neutral position, in cooperation with an oscillator organ of the escapement.

FIG. 7 proposes a second embodiment of the invention, in which the corrector according to the invention has, arranged symmetrically relative to an axis parallel to the axis AA, two correctors as described above, each defining first and second portions. In this figure as in FIG. 13, the pallet 6 includes two pins 9, which are shown in neutral position. The four elastically deformable structures are also presented in neutral position, i.e. not deformed. Preferably, in order to decrease the bulk of such a corrector, the flexible blades 14, the deformable structures and the frame 12 of the first and second portions form a planar piece, preferably made monolithically, by techniques known by those skilled in the art, such as wire electroerosion, photolithography or deep etching.

In a planar structure as proposed in the drawing, the centers of rotation of the deformable structures cannot be combined with the center of rotation of the pallet 6, as for the first embodiment. To best approach these optimal conditions described above in reference to FIGS. 2 and 9, the pivot center of the pallet 6 is positioned at the middle of the segment connecting the pivot centers of the deformable structures, on one hand, of the first portion of the corrector and, on the other hand, of the second portion of the corrector. The blades 14 are arranged as close as possible to a line perpendicular to the path of the oscillator.

Figure 8:
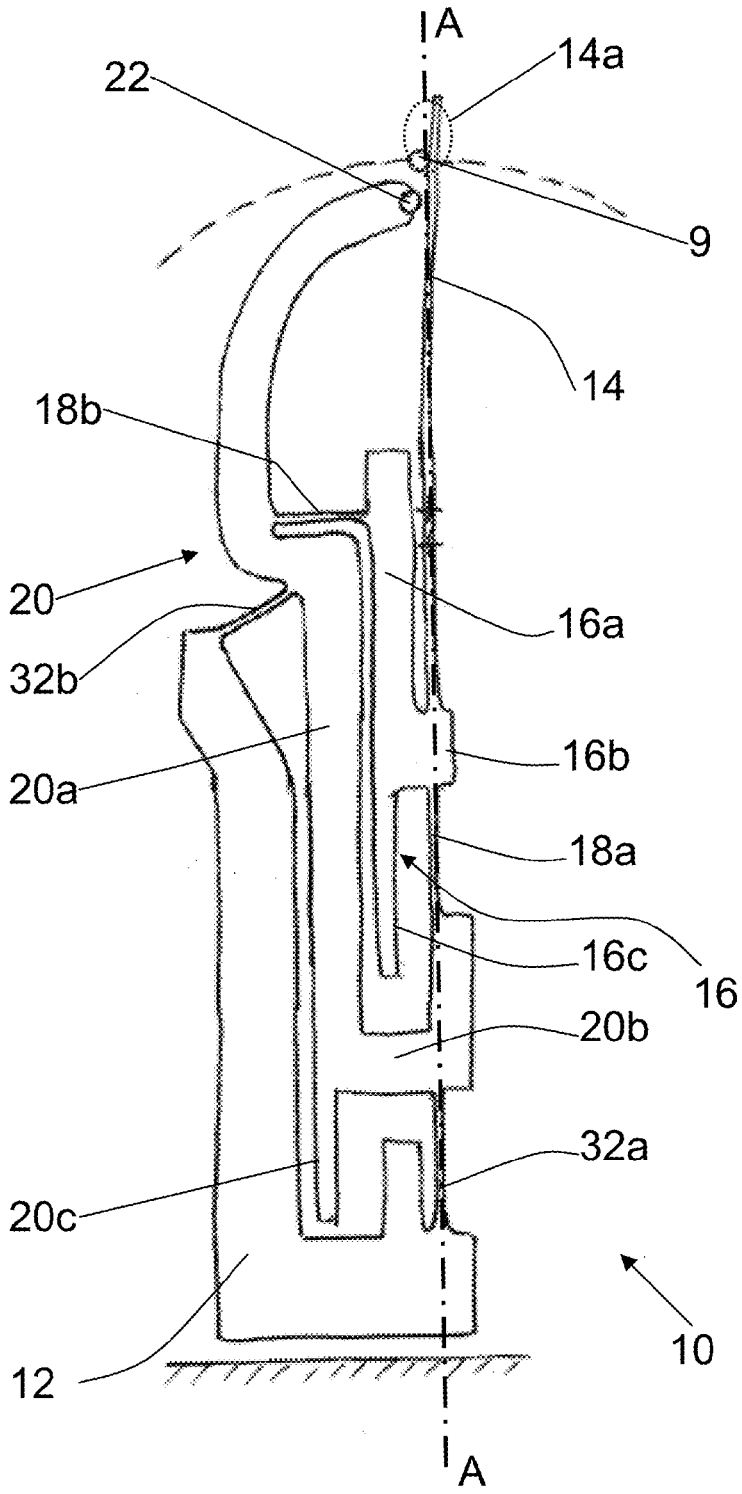
FIG. 8 illustrates a top view of a corrector according to the invention, with an illustration of the action of the third adjustment means.

FIG. 8 illustrates a third adjustment that the isochronism corrector, in its simple or symmetrical versions, may present. This adjustment makes it possible to act on the active length of the flexible blade 14 in reference to the oscillator. In other words, one acts on the distance between the embedding point of the flexible blade 14 and the support point of the flexible blade 14 on the pin 9. To do this, the frame 12 is mounted mobile in translation in reference to the oscillator, along a direction parallel to the axis AA. This can be simply obtained by oblongs 36 arranged in the frame 12, inside which tightening screws 38 cooperate (FIG. 12). A modification of the apparent rigidity of the flexible blade 14 results from this adjustment. In FIG. 8, we have shown an offset of the corrector toward the oscillator, which shortens the active length of the flexible blade 14 and therefore increases its apparent rigidity. Note that this adjustment does not have any effect on the pre-stress strength of the flexible blade 14 against the pre-stress finger 22. Moreover, if the angular position of the pin 9 for which the latter loses contact with the flexible blade 14 during its movement to the left (in reference to the drawing) is situated in reference to the pre-stress finger 22, on a line parallel to the axis AA, then the adjustment of the rigidity illustrated in this figure also has no influence on the adjustment of the contact angle described in FIG. 6. Lastly, note that the adjustment illustrated in this FIG. 8 offsets the pivot center of the elastically deformable structures relative to the center of rotation of the anchor. This offset results in slightly increasing the friction at the point of contact between the pin 9 of the pallet 6 and the flexible blade 14, but in acceptable proportions.

The isochronism corrector according to the invention can be machined in a metal alloy sheet with properties adapted to the manufacture of springs (one may choose copper- and beryllium-based or carbon steel-based alloys, known by those skilled in the art). The various boring, tapping and milling is done first. Then, a treatment is done by structural curing. Lastly, the elastic structure is cut by wire electroerosion (EDM).

Other materials can also be used, as long as they have satisfactory elastic characteristics. The production technique is adapted to the material used. One may in particular produce the corrector in silicon, using the DRIE (Deep Reactive Ion Etching) technique.

FIGS. 10 and 11 show positioning systems making it possible to adjust the deformation of the deformable structures, used advantageously in an isochronism corrector according to the invention. A person skilled in the art may consider using other positioning systems. The figures particularly show the positioning system 24 of the first deformable structure, but the positioning system 34 of the second deformable structure is quite similar.

In the illustrated example, each positioning system includes two cone-point set screws 40, which ensure both the adjustment strictly speaking, i.e. the movement of the elastically deformable structure, and the locking of its position. The cone-point set screws 40 are screwed into blom studs 41, themselves fastened to the frame 12 of the corrector.

One cone-point set screw 40 is arranged on each side of the intermediate elements 16 and 20, at their tail 16*c* or 20*c*, in cooperation therewith. At the location where the screws 40 exert their action, the tail 16*c* or 20*c* has a circular hollow 42, such that the action of the conical portion of the cone-point cooperates effectively with the intermediate element 16 or 20. The cone-point set screws 40 are arranged eccentrically relative to the circular hollow 42, while being offset on the side of the tail 16*c* or 20*c*. Thus, the cone-point set screws 40 only exert pressure on the intermediate element 16 or 20 with which they cooperate. The driving in of the cone-point set screw 40 in reference to the intermediate element 16 or 20 and therefore the radius of the cone at the contact with the hollow 42, makes it possible to adjust the position of the intermediate element 16 or 20.

Thus, one slightly loosens one of the screws 40 of a positioning system, then, one brings the tail 16*c* or 20*c* into contact with that screw 40 by lightly gripping the other screw 40. The movement made can be estimated using an angular reference fixed directly on the tightening screws. Depending on the angle of the cone of the cone-point set screw 40 and the pitch thereof, one can estimate that the adjustment of the deformable structures can be done with a precision in the vicinity of the micron. When the two screws acting at an intermediate element 16 or 20 are tightened, the position of that element is secured. It is particularly interesting to be able to adjust the position of the deformable structures and the locking of their positioning, using a single device, because in this way, one avoids any risk of modifying the adjustment during locking.

Lastly, FIG. 12 shows the corrector according to the invention in its symmetrical version, provided with positioning systems 24 and 34 of each of the elastically deformable structures. One can see that the screws of the adjustment systems are advantageously accessible by the top, which, given the precision of the adjustments to be made, is an important advantage at the practical level, for operations to be done manually by an horologist.

Thus is proposed an isochronism corrector offering particularly interesting ease of adjustment of its action on a mechanical oscillator. Moreover, its design allows an easy and precise realization, while limiting the bulk generated in the clockwork movement.

A person skilled in the art may consider various alternatives, without going beyond the scope of the invention defined by the claims. Thus, it is possible to consider producing a corrector comprising several portions, as described in the first embodiment, in reference to FIGS. 1 to 6. The blades of the different portions used may not be parallel, or not arranged symmetrically, although those configurations are less favorable.

Figure 14:
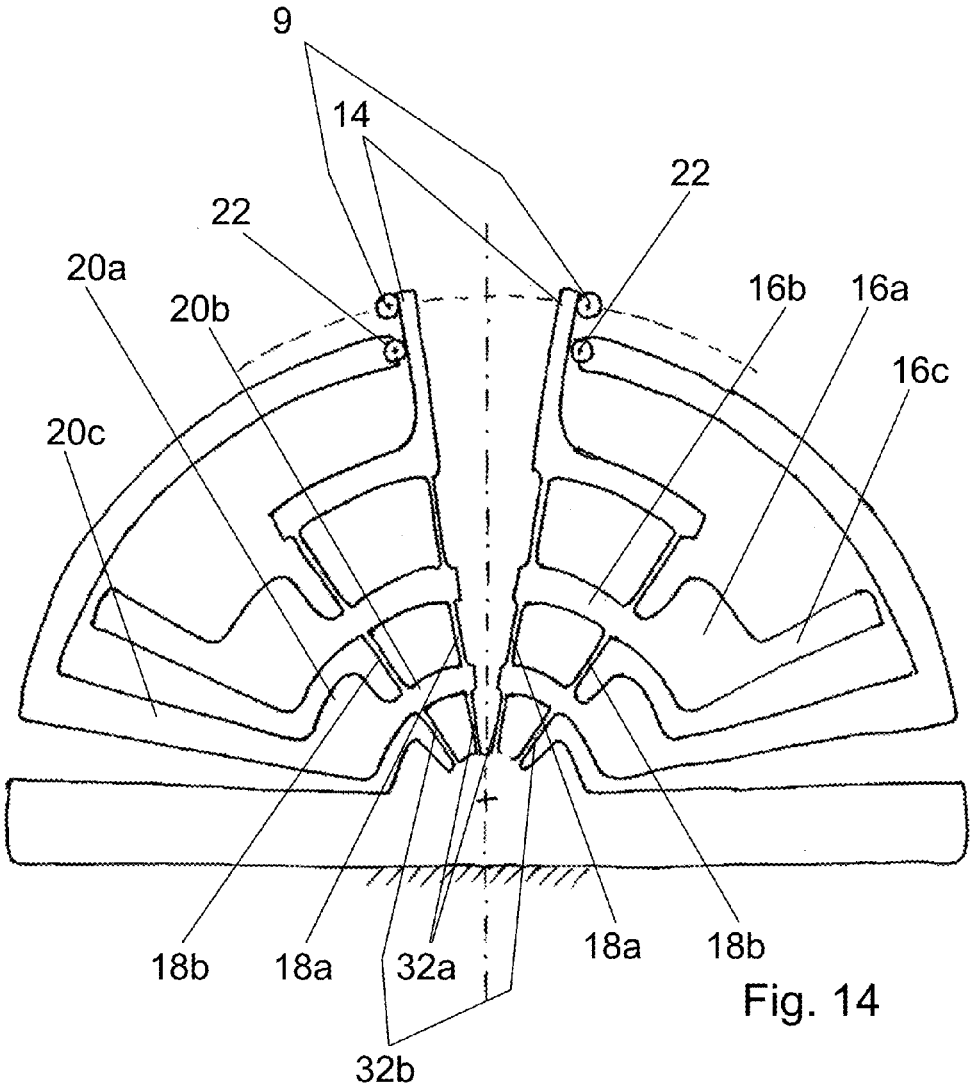

Moreover, one will note that the notion of flexible blade must be interpreted broadly. Thus, according to the definition given by the "Dictionnaire professionnel illustré de l'horlogerie" by G. A. Berner, a blade is a thin, flat, flexible piece of metal. The flexibility can be achieved on the entire length of the blade or only a limited portion thereof. One can also consider having a blade whereof the flexibility is obtained by an elastically structure [sic] around a remote center compliant flexure pivot. FIG. 14 proposes such an arrangement, in which each corrector portion has three remote center compliant structures, two similar to those described above, and one to ensure the flexure of the blade. One will note that, particularly advantageously, it is possible, in such a configuration, for the centers of rotation of the deformable structures to be combined with the center of rotation of the pallet 6, as for the first embodiment described above.

One will note that, in the case of a structure with two identical portions but that are arranged in different planes, it is also possible for the centers of rotation of the pallet and of the deformable structures of each of the portions to be superimposed. Such an embodiment can also be done monolithically.

What is claimed is:

1. A mechanical oscillator isochronism corrector including:

a frame, a flexible blade integral with the frame, said flexible blade being arranged to act on a mechanical oscillator at a contact portion presented by the blade, first means for adjusting the pre-stress of said flexible blade comprising a pre-stress finger acting on said flexible blade, said first adjustment means being integral with the frame.

2. The corrector of claim 1, also including second means for adjusting the position of the contact portion, to adjust the position in which the oscillator comes into contact with the flexible blade, said second adjustment means being integral with the frame and being independent of the first adjustment means.

3. The corrector of claim 2, wherein said first and second adjustment means are each made up of an elastically deformable structure around a remote center compliant flexure pivot, each structure being independently deformable via a respective positioning system.

4. The corrector of claim 3, wherein the compliance center of the first adjustment means is situated at the same location as the compliance center of the second adjustment means.

5. The corrector of claim 4, wherein the deformable structure of said first adjustment means includes a first intermediate element, integral with the flexible blade and first and second elastic blades connected, on one hand, to a reference element provided with said pre-stress finger and, on the other hand, to said first intermediate element.

6. The corrector of claim 5, wherein the reference element of the deformable structure of said first adjustment means is formed by the deformable structure of said second adjustment means.

7. The corrector of claim 6, comprising, arranged on a same frame, a number n of additional correctors.

8. The corrector of claim 7, including two correctors arranged symmetrically relative to a line perpendicular to the path of a support zone of the oscillator.

9. The corrector of claim 4, wherein the deformable structure of said second adjustment means includes a second intermediate element integral with flexible blade, first and second elastic blades connected on one hand to a reference element and, on the other hand, to said second intermediate element.

10. The corrector of claim 9, wherein the reference element of the deformable structure of said first adjustment means is formed by the deformable structure of said second adjustment means.

11. The corrector of claim 9, comprising, arranged on a same frame, a number n of additional correctors.

12. The corrector of claim 11, including two correctors arranged symmetrically relative to a line perpendicular to the path of a support zone of the oscillator.

13. The corrector according to claim 11, wherein the frame, the blades and the elastically deformable structures form a planar and/or monolithic piece.

14. The corrector according to claim 3, wherein the frame, the blade and the elastically deformable structures form a piece, said piece being at least one of planar and monolithic.

15. An escapement mechanism comprising:

a corrector according to claim 14, said flexible blades having a length L and an end integral with the frame, and a mechanical oscillator having first and second support zones designed to cooperate respectively with the contact portion of the first and second flexible blades, said support zones describing a single circular path, wherein said blades are arranged as close as possible to a line perpendicular to the path of the oscillator.

16. The escapement mechanism according to claim 15, wherein the center of said path is situated symmetrically between said flexible blades, at a normal distance L/3 from their connection point to the frame.

17. The corrector of claim 1, also including third means for adjusting the angular rigidity of said flexible blade in reference to the mechanical oscillator, by translation of the frame.

18. An escapement mechanism comprising:

a corrector according to claim 1, said flexible blade having a length L and an end integral with the frame, and a mechanical oscillator having a support zone designed to cooperate with the contact portion of said flexible blade, said support zone describing a circular path, wherein the blade is arranged along a line perpendicular to said path and in that the center of said path is situated in the plane of said blade, at a distance L/3 from its connection point to the frame.

* * * * *